US006688346B2

(12) United States Patent
Brahier et al.

(10) Patent No.: US 6,688,346 B2
(45) Date of Patent: Feb. 10, 2004

(54) CONTINUOUS STRIP BAG FEEDER AND LOADER WITH INTEGRATED PRINTER ASSEMBLY

(75) Inventors: Timothy E. Brahier, Rome, WI (US); James W. Gleesing, Whitewater, WI (US)

(73) Assignee: Sharp Packaging Systems, Inc., Sussex, WI (US)

( * ) Notice: Subject to any disclaimer, the term of this patent is extended or adjusted under 35 U.S.C. 154(b) by 0 days.

(21) Appl. No.: 10/045,435

(22) Filed: Nov. 7, 2001

(65) Prior Publication Data

US 2002/0062920 A1 May 30, 2002

Related U.S. Application Data

(60) Provisional application No. 60/247,025, filed on Nov. 8, 2000.

(51) Int. Cl.[7] ..... B65B 41/16; B65B 43/36; B65B 61/02

(52) U.S. Cl. ..... 141/314; 141/10; 141/98; 141/114; 141/173; 53/131.5; 53/385.1; 53/459; 53/570

(58) Field of Search ..... 141/10, 98, 114, 141/131, 166, 173, 314; 53/131.2, 131.4, 131.5, 284.7, 385.1, 411, 459, 469, 570

(56) References Cited

U.S. PATENT DOCUMENTS

| | | | | |
|---|---|---|---|---|
| 2,037,825 A | | 4/1936 | Salfisberg | 93/6 |
| 3,650,773 A | | 3/1972 | Bush et al. | 99/171 |
| 4,387,550 A | | 6/1983 | Lerner | 53/459 |
| 4,490,963 A | | 1/1985 | Knudsen | 53/559 |
| 4,586,318 A | | 5/1986 | Litt et al. | 53/459 |
| 4,790,118 A | | 12/1988 | Chilcoate | 53/411 |
| 4,901,506 A | | 2/1990 | Weyandt | 53/479 |
| 4,988,520 A | | 1/1991 | Overton | 426/74 |
| 5,341,625 A | | 8/1994 | Kramer | 53/459 |
| 5,626,004 A | | 5/1997 | Gates et al. | 53/459 |
| 5,761,877 A | | 6/1998 | Quandt | 53/155 |
| 6,170,230 B1 | * | 1/2001 | Chudy et al. | 53/168 |
| 6,470,648 B1 | | 10/2002 | Baker | 53/411 |
| 6,543,201 B2 | * | 4/2003 | Cronauer et al. | 53/131.5 |

FOREIGN PATENT DOCUMENTS

| | | |
|---|---|---|
| GB | 1533173 | 11/1978 |
| JP | 2000-128103 | 5/2000 |
| WO | WO 00/32477 | 6/2000 |

OTHER PUBLICATIONS

Patent Abstracts of Japan vol. 2000, No. 10, Nov. 17, 2000 and JP 2000 185703 (Tooshoo:KK); Jul. 4, 2000.
Patent Abstracts of Japan vol. 2000, No. 08. Oct. 6, 2000 and JP 2000 142602 (Takazono Sangyo KK), May 23, 2000.
Patent Abstracts of Japan vol. 1997, No. 02, Feb. 23, 1997 and JP 08 266590 (Tokyo Shokai:KK), Oct. 14, 1996.
"Change Your Total Packaging Costs with the Dependable BPS–2" brochure, Sharp Packaging Systems, Inc.

* cited by examiner

*Primary Examiner*—Gregory L. Huson
*Assistant Examiner*—Peter deVore
(74) *Attorney, Agent, or Firm*—Andrus, Sceales, Starke & Sawall, LLP

(57) ABSTRACT

A continuous strip bag feeder and loader that includes an integrated printer assembly for printing information on each individual bag of the continuous strip. The printer assembly is mounted to a support frame and receives a continuous strip of bags from a feed assembly. The printer assembly includes a print head that prints the desired information on each individual bag of the continuous strip. The printer assembly is positioned relative to the loading assembly such that after each individual bag is printed, the bag is immediately loaded with a product at the loading assembly. Thus, no printed bags are positioned between the loading assembly and the printer assembly, thereby assuring each bag is loaded with a product prior to the printing of another bag.

8 Claims, 5 Drawing Sheets

CONTINUOUS STRIP BAG FEEDER AND LOADER WITH INTEGRATED PRINTER ASSEMBLY

CROSS-REFERENCE TO RELATED APPLICATION

The present invention is based on and claims priority from U.S. Provisional Patent Application Serial No. 60/247,025, filed on Nov. 8, 2000.

BACKGROUND Of THE INVENTION

The present invention relates to an apparatus for feeding and loading individual bags formed in a continuous strip in which successive bags are connected end to end. More specifically, the present invention relates to an apparatus that includes an integrated printer assembly that prints a label or product marking on each of the bags in a continuous strip immediately prior to the printed bag being loaded with the product being packaged.

Currently, many manufacturers utilize automated loading machines to load products to be packaged into individual plastic bags. The plastic bags are typically contained in a "wicket" in which successive bags are stacked on top of each other and held in alignment by a header having a series of wicket rods. Once each bag is filled with the product to be packaged, the bag is torn along a line of perforation and separated from the header that aligns the stack of bags. After the bag has been filled with the product, the bag is transferred to a drop sealer in which the two layers of plastic forming the bag are heat sealed in a conventional manner. Although the combination of a wicketed bag loading machine and a drop sealer is in wide use and has proven to be effective, drawbacks exist in the use of plastic bags stacked in the wicket package.

One such drawback is the limitation in the type of printing that can be applied to the individual bags in the wicket. Since the bags in the wicket are stacked on top of each other and are loaded with a product while still attached to the wicket header, there is no possibility of printing a design on the plastic bag prior to the insertion of the product. Although the wicketed bags could be printed prior to assembly into the wicketed packet, the manufacturer of the wicketed bags typically mass produces the bags without customizing the bags for the individual customer. Thus, if the customer wishes to imprint information on the bags after purchase from the manufacturer, the wicketed bags must be imprinted after the product has been loaded and the wicketed bag sealed by the drop sealer. If the product being sold in the sealed plastic bags includes an irregular surface, printing after the bag has been filled can prove to be a difficult and imprecise proposition.

Recently, continuous strips of bags that are end connected have become available for use in packaging products. Each of the bags in the continuous strip includes an open end that is connected to the closed end of the next bag in the continuous strip. Rolls of continuous strip bags can include at least 1000 bags. However, the automated feeding and loading of the continuous strip of bags has also presented problems in the feeding of the bags from the supply source and the opening of the bags in the continuous strip prior to loading of the products to be packaged.

In currently available packaging apparatus that open and load continuous strips of bags that are end connected, the printing on each bag is done by a printer that is typically located upstream from the location at which the printed bag is loaded with the product being packaged. Although an upstream printer is adequate when loading identical products into bags such that the printing on each individual bag does not have to correspond to the particular product being packaged, drawbacks exist if the bag feeding and loading apparatus is used to package products that are specialized and require specific labeling for the product being packaged. For example, if the bag feeding and loading apparatus is used to package medical prescriptions for individual patients, it is critical that the information printed upon each individual bag matches the product being placed within the bag. In a feeding and loading apparatus in which several cycles of the apparatus take place between the printing of an individual bag and the loading of the same bag, an opportunity exists for misalignment between the printed product packaging and the actual product being inserted therein.

In addition to the possible misidentification that can occur due to the number of bags positioned between the bag being loaded and the bag being printed, the printed bags extending between the loading area and the printing area result in wasted product during changeovers from bag types or the type of printing being placed upon the bag. In many cases, as many as four to six bags can be wasted during each changeover.

Therefore, it is an object of the present invention to provide an apparatus that can be used to print, feed and load individual bags with increased accuracy. Further, it is an object of the present invention to provide such an apparatus that feeds an article into the bag immediately following the printing of the bag by the integrated printing assembly. Further, it is an object of the present invention to position the printing assembly immediately adjacent to the loading location for the bag, such that the loading and printing occurs in the same cycles of the apparatus to improve the accuracy between the printed information and the product and decrease product loss.

SUMMARY OF THE INVENTION

The present invention is an device for feeding, printing and loading a bag from a continuous strip of bags with a desired product to be packaged. The apparatus of the present invention is particularly desirable in loading individualized products into successive bags where each of the bags must be individually printed with information specifically related to the product being placed within the bag.

The device of the present invention includes a feed assembly that feeds a continuous supply of bags from a supply source. If the supply source is a roll of bags, the feed assembly includes a series of dancers that maintain tension in the strip. Alternatively, if the continuous strip of bags are formed as a fan-folded supply, the feed assembly includes a vacuum tensioning roll that ensures that the fan-folded continuous strip of bags is fed to the remaining components of the apparatus under tension.

A printer assembly is positioned adjacent to the feed assembly to receive the continuous strip of bags to be loaded. The printer assembly is operable to print various types of indicia or information on the individual bags of the continuous strip. The printer assembly receives control and printing information from a control unit such that the printer assembly can be operated to print different types of information on successive bags of the continuous strip.

Positioned immediately downstream from the printer assembly is a loading assembly. The loading assembly receives the bag that has just been printed by the printer assembly and opens the bag such that a product can be placed into the bag. The loading assembly is positioned immediately adjacent to the printer assembly such that the last bag that was printed by the printer assembly is immediately loaded with the product being packaged. In this manner, no individual bags are positioned between the bag currently being loaded and the bag currently being printed. Thus, the apparatus of the present invention ensures that each individual bag is loaded with product immediately after the individual bag has been printed.

After the individual bag has been printed and loaded by the apparatus of the invention, the bag is separated from the continuous strip and sealed in a downstream process.

As discussed above, the apparatus of the present invention is capable of printing and loading each pre-opened bag during one cycle of the device operation. In this manner, the device ensures that the contents of the package will match the information printed on the bag.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
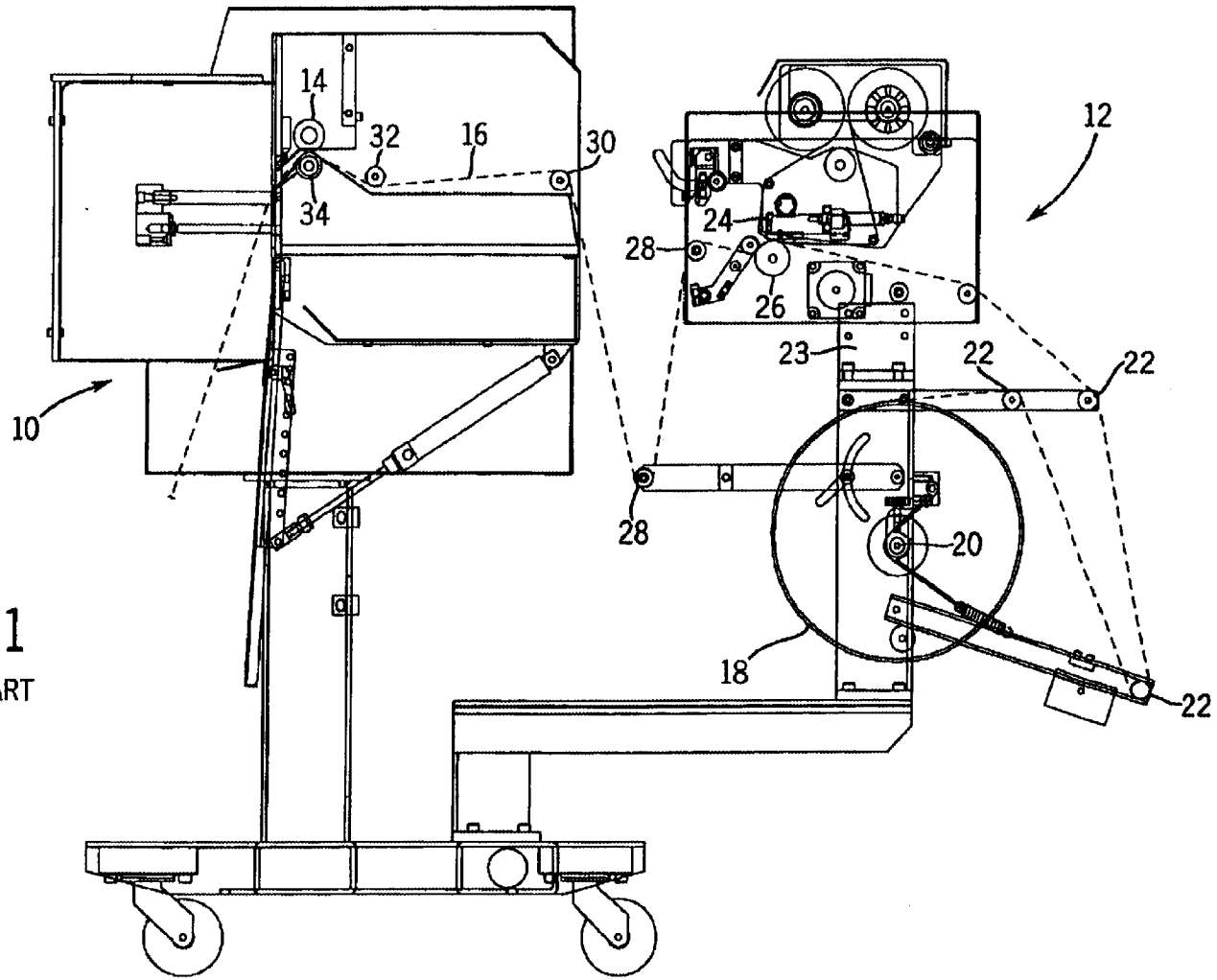
FIG. 1 PRIOR ART
FIG. 1 is a side view of a prior art continuous strip bag feeder including a separate printer assembly located upstream from the bag loader.

Referring first to FIG. 1, thereshown is a prior art bag feeding and loading device 10 that includes a separate printer assembly 12. The bag feeding and loading device 10 shown in FIG. 1 is commercially available as model BPS-2 from Sharp Packaging System, Inc. of Sussex, Wis., owner of the present application.

The bag feeding and loading device 10 includes a drive roller 14 that is operable to pull a continuous strip of bags 16 from a supply roll 18. The bag loading and feeding device 10 includes a supply of air positioned downstream from the drive roll 14 that blows open each bag of the continuous strip 16 such that a product can be loaded into the bag. Although not shown in FIG. 1, the bag loading and feeding device 10 includes a sealing mechanism that seals the plastic bag containing the packaged product.

As illustrated in FIG. 1, the bag feeding and loading device 10 receives a continuous supply of bags from the roll 18. In the embodiment of the invention illustrated, the continuous strips of bags will be described as being fed from a roll rotatably supported about a support shaft 20. Each individual bag in the continuous strip 16 is end connected to a leading and a tailing bag such that the continuous strip can be fed through the bag feeding and loading device 10. Although the supply of bags is described as being included on the supply roll 18, it is contemplated by the inventors that the continuous strip of bags could be fed from a supply of fan-folded bags each end connected and stacked in a storage container.

As illustrated in FIG. 1, the continuous strip of bags 16 is fed from the supply roll 18 through a series of dancer rolls 22 to the printer assembly 12. The dancer rolls 22 guide the continuous strip at the proper orientation for entry into the printer assembly 12.

The printer assembly 12 is a separate component from the bag feeding and loading device 10 and is mounted to a separate vertical support 23. The printer assembly 12 includes a print head 24 positioned above a drive roll 26. The print head 24 thermally applies the required information to each individual bag as the bag moves through the printer assembly 12. As illustrated, the printer assembly 12 is a removable component that can be eliminated or bypassed if the bags do not need to be printed.

After each bag has been printed, the continuous strip passes over a pair of compensator rollers 28 and enters into the bag feeding and loading device 10 around the guide roller 30. A second guide roller 32 directs the continuous strip between the drive roller 14 and a pinch roller 34. The drive roller 14 moves the continuous strip 16 until one full bag is in the loading position.

As can be understood in FIG. 1, a substantial length of the continuous strip 16 extends between the drive roll 14 of the bag feeding and loading device 10 and the print head 24 of the printer assembly 12. In several applications, as many as 4–6 printed bags can be positioned between the print head 24 and the drive roller 14. Thus, after each individual bag is printed, the bag is not loaded with a product for several cycles of operation after the bag has been printed. Although this delay between printing and loading of each individual bag is acceptable when the printing on the bag is not specifically related to the type of product being inserted, many applications exist where it is critical to ensure that the printing on the bag corresponds to the type of product being inserted. For example, when loading medical prescriptions into shipment bags, it is critical that the correct prescription is loaded into the correct bag for each individual patient.

Figure 2:
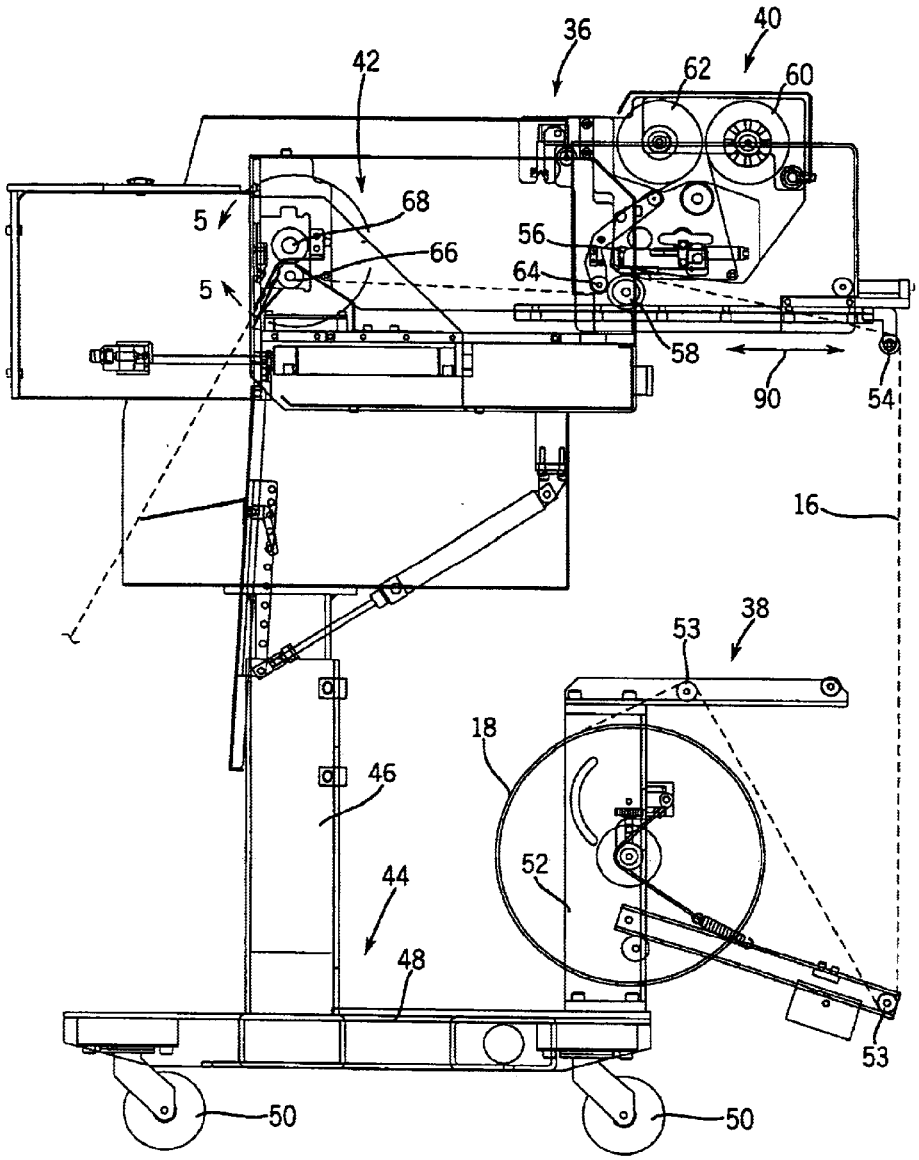
FIG. 2 is a side view of the continuous strip bag feeder, loader and printer assembly of the present invention.

Referring now to FIG. 2, thereshown is the combination bag feeding, printing and loading device 36 of the present invention. The bag printing and loading device 36 generally includes a feed assembly 38, a printer assembly 40 and a loading assembly 42 incorporated into a single device.

The device 36 of the present invention includes a support frame 44 having an upright support post 46 used to support both the printer assembly 40 and the loading assembly 42. The upright support post 46 is supported by a lower platform 48 having a series of caster wheels 50. The lower support platform 48 and the caster wheels 50 allow the entire device 36 to be easily transported to various locations within a workplace.

As illustrated in FIG. 2, the feed assembly 38 includes a pair of spaced supports 52 (only one shown) that rotatably support the supply roll 18. The supply roll 18 includes the same type of continuous strip of bags as illustrated in FIG. 1. As illustrated, the continuous strip of bags pass around a pair of dancer rolls 53 and pass over a roller 54 associated with the printer assembly 40. The dancer rolls 53 and the support roll 54 aid in directing the continuous strip of bags 16 and maintain the proper tension on the bags for the operations to follow.

Although not shown in the Figures, the feed assembly 38 can be configured to include a vacuum tensioning roll if the strip of bags is supplied from a fan-folded continuous strip packaged in a box. The vacuum tensioning roll provides a source of tension for the continuous strip, such that the printing assembly 40 and the loading assembly 42 can correctly operate on the continuous strip.

As illustrated in FIG. 2, the printer assembly 40 includes a print head 56 that is positioned above a drive roll 58 for imprinting information onto the flat, face surface of each individual bag of the continuous strip 16. The print head 56 utilizes a print ribbon from the supply roll 60. After the ribbon has been used, the used ribbon is collected on a take-up roll 62 contained within the printer assembly.

As illustrated in FIG. 2, a pinch roller 64 applies pressure between the strip of bags and the drive roller 58 such that the drive roller 58 can pull the continuous strip 16 through the printer assembly 40.

After each bag has been printed within the printer assembly 40, the bag is pulled into the loading assembly 42 by a drive roller 66. The drive roller 66 creates a nip with the pinch roller 68 such that the drive roller 66 can pull the continuous strip into the loading assembly 42 at an accurate and controlled speed.

After each individual bag has passed between the nip formed by the drive roller 66 and the pinch roller 68, the bag extends out of the loading assembly 42 where an air blower is directed onto the bag, which opens the bag such that a product can be inserted within the bag. After a product has been inserted, the bag is separated from the continuous strip and thermally closed for shipment.

As can be understood in FIG. 2, the bag feeding, printing and loading device 36 of the present invention is constructed such that the distance between the print head 56 and the nip formed by the drive roller 66 and the pinch roller 68 is less than the length of an individual bag being printed. In this manner, the device 36 of the present invention is able to print an individual bag immediately prior to the bag being loaded with product, unlike the prior art system illustrated in FIG. 1 in which multiple bags are positioned between the print head and the loading assembly.

Figure 3:
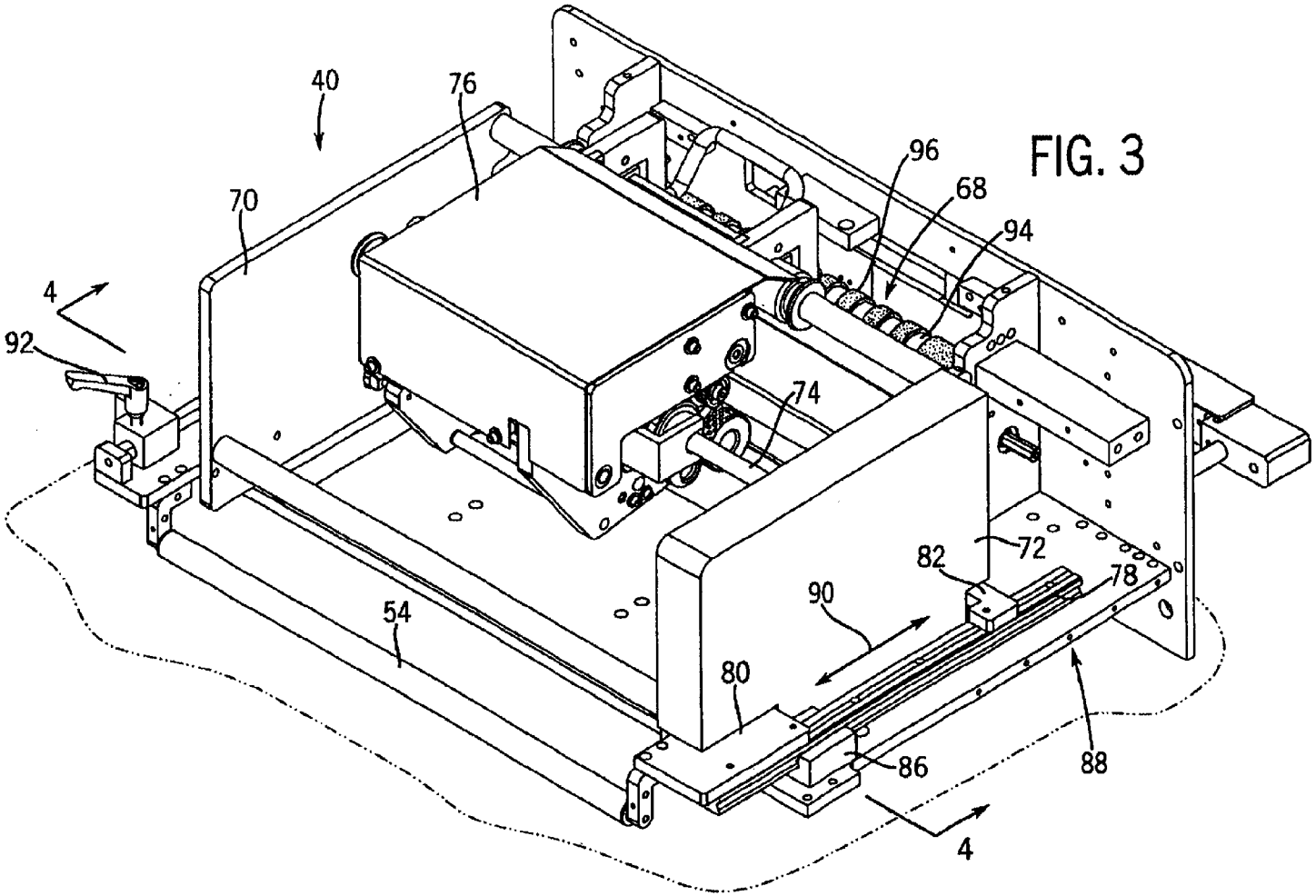
FIG. 3 is a top, perspective view of the printer assembly and loading assembly of the present invention.

Referring now to FIG. 3, thereshown is a detailed illustration of the printer assembly 40 of the present invention. The printer assembly 40 includes a pair of side plates 70 and 72. A support rod 74 extends between the side plates 70 and 72. A printer 76, including the print head, is mounted to the support rod such that the printer 76 can move laterally between the side plates 70 and 72. The lateral movement of the printer 76 between the side plates 70 and 72 allows the print head to be positioned at different locations on the bag, depending upon where the printed information is to be located.

Figure 4:
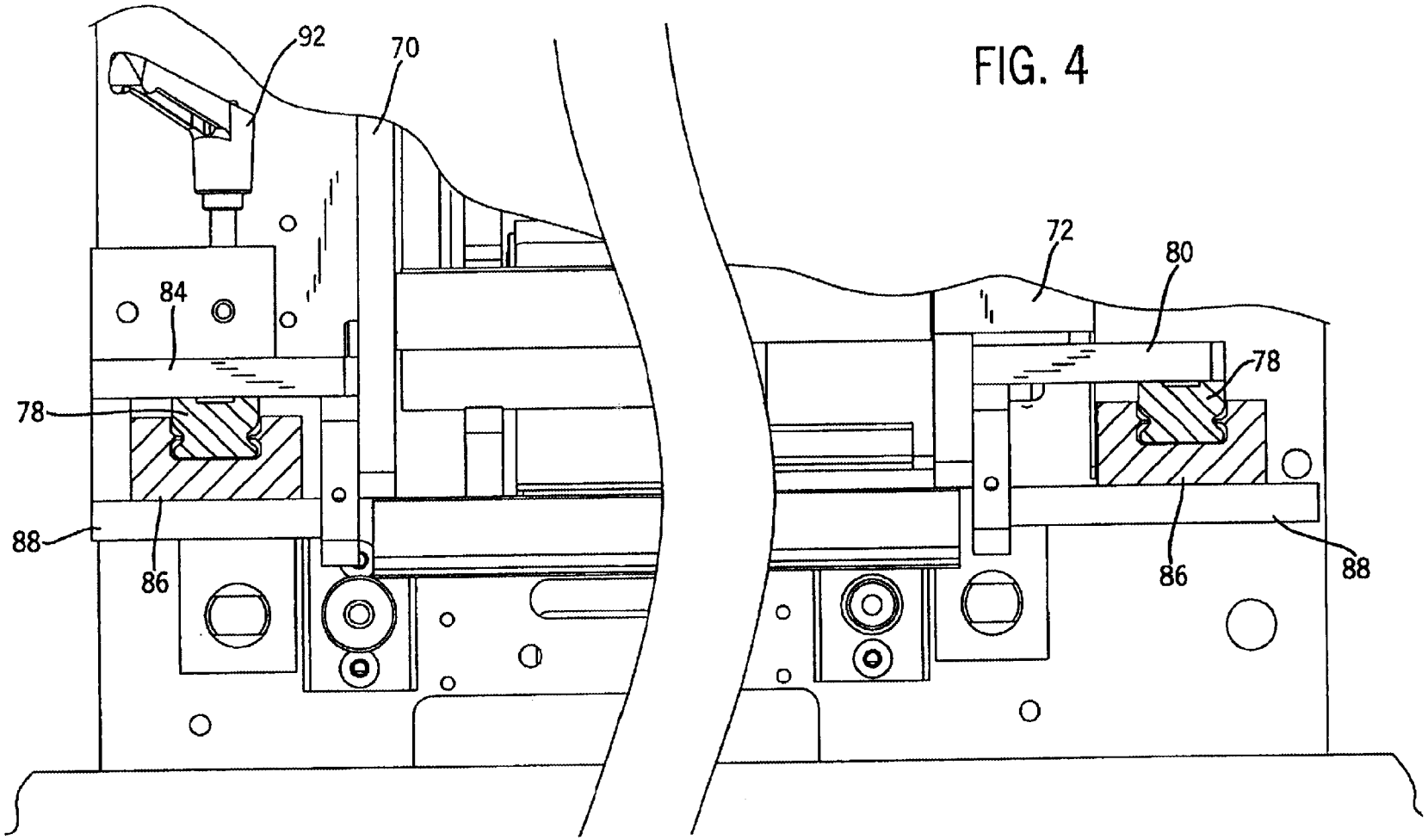
FIG. 4 is a section view taken along line 4—4 of FIG. 3 illustrating the mounting of the printer assembly between a pair of spaced guide rails.

As illustrated in FIG. 3, the side plate 72 is securely mounted to a guide rail 78 by a pair of support blocks 80 and 82. As can be seen in FIG. 4, a corresponding guide rail 78 is associated with the side plate 70 and the support block 84. Each of the guide rails 78 is received within a guide block 86 that is fixed on the support frame 88. The configuration of the guide rails 78 and the guide blocks 86 allow the entire printer assembly 40 to move relative to the fixed guide block 86, as illustrated by arrow 90 in FIGS. 2 and 3. As can be best understood in FIG. 2, movement of the entire printer assembly 40 in the direction illustrated by arrow 90 allows the distance between the print head 56 and the drive roller 66 of the loading assembly 42 to be adjusted based upon the length and type of bag being printed.

Referring back to FIG. 4, a locking handle 92 is positioned on one side of the printer assembly 40 to secure the printer assembly 40 in a desired location. The locking handle 92 restricts the movement of the guide rail 78 within the guide block 88 such that the printer assembly 40 maintains a desired distance from the loading assembly.

Referring back to FIG. 2, once the individual bag has been printed, the bag is received between the drive roller 66 and the pinch roller 68. The drive roller 66 is independently operable from the printer assembly such that the loading assembly can move the strip of bags independently from the operation of the printer. This is particularly important in applications in which information is not printed on the bag and the printer assembly 40 is thus inoperative.

Figure 5:
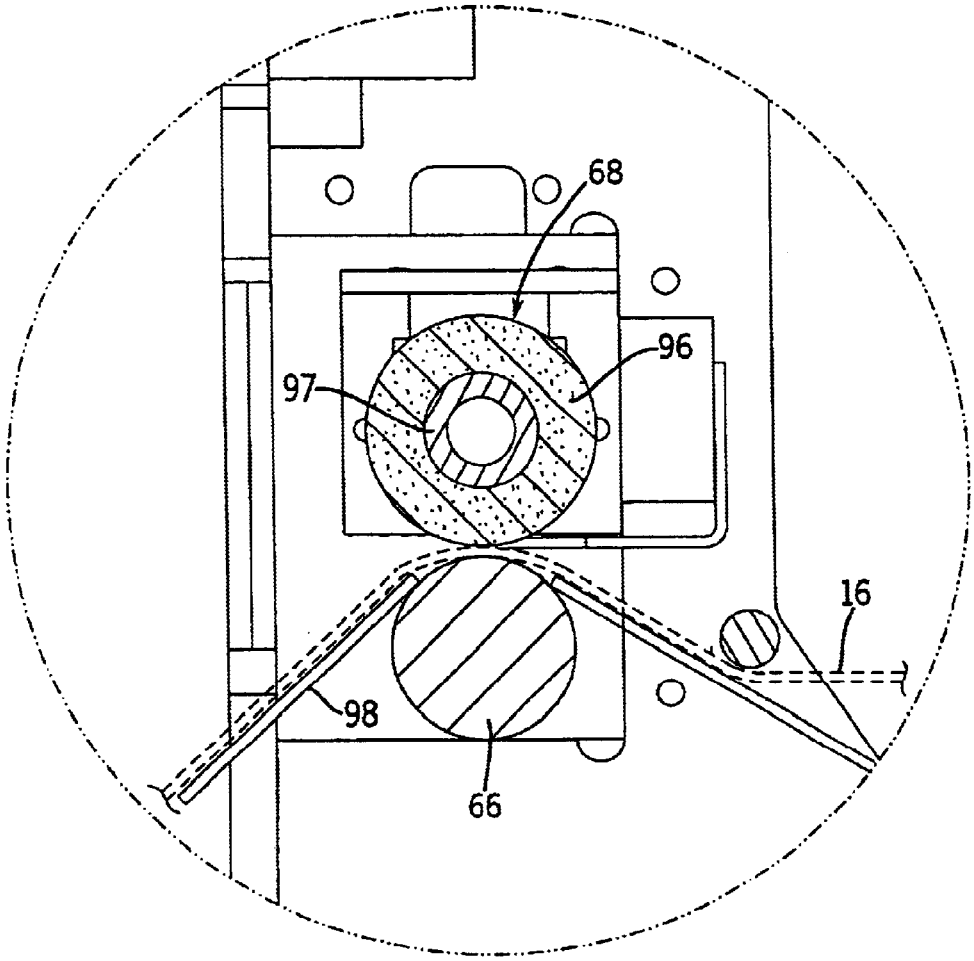
FIG. 5 is a view taken along line 5—5 illustrating the drive assembly used to move the continuous strip of bags through the loading assembly.

As can be seen in FIG. 3, the pinch roller 68 includes a plurality of recessed notches 94 positioned between spaced engagement sections 96. The engagement sections 96 are preferably formed from a resilient material that slightly compresses when positioned in contact with the drive roller 66, as best seen in FIG. 5. The engagement portions 96 of the pinch roller 68 extend radially from the metallic surface of the inner cylinder 97 to define the notches. The notches allow a plurality of individual spring fingers 98 to extend into the nip in the removed areas formed by the notches. The fingers 98 prevent the continuous strip of bags 16 from wrapping around the rotating drive roller 66.

Once the individual bag has passed between the drive roller 66 and the pinch roller 68, the bag is opened by a blower assembly (not shown) and loaded with product either manually or automatically. Once the product has been loaded, the bag can be separated along a line of perforation and sealed in one of numerous conventional manners. As discussed previously, an important feature of the invention is the ability of the device 36 to load the bag that was just printed such that the specific product being placed in the bag directly corresponds to the information being printed on the exterior of the bag.

Although not shown in the drawings, the feeding, printing and loading device 36 of the present invention includes a control unit that monitors the operation of the printer assembly and loading assembly to synchronize and control the printing and loading of the product into each individual bag. The control assembly allows the user to enter specific information concerning the size and type of bag being printed, as well as the printing information and the desired location for the printed information on the bag.

Referring now to FIG. 2, the operation of the combination bag feeding, printing and loading device 36 of the present invention will now be described. Initially, the continuous strip of bags from the supply roll 18 is fed around the dancer rolls 53 and fed into the printer assembly 40. Specifically, the continuous strip 16 is fed between the print head 56 and the drive roller 58. From the drive roller 58, the continuous strip is fed between the drive roller 66 and the pinch roller 68 and fed out of the device until the first bag of the strip is in the proper position beneath the pressure bar (not shown) that seals the bag. Once in this position, the electronic control unit is initialized and loading can begin.

Once the end bag has been loaded and removed from the continuous strip by tearing the bag along the perforations, a sensor signals the control unit, which sends a signal to the loading assembly 42 and the printer assembly 40 indicating that the next bag can be printed. The drive roller 66 of the loading assembly 42 and the drive roller 58 of the printer assembly 40 advance the continuous strip until the desired location on the bag being printed is positioned beneath the print head 56. If the device 36 is configured to ensure that the bag being loaded is the last bag printed, the printer assembly 40 must be positioned relative to the drive roller 68 such that the distance between the drive roller 66 and the print head 56 is less than the overall length of the bag being printed.

Once the bag is in the proper location, the drive roller 58 of the printer assembly 40 moves the bag beneath the printer head 56 such that the correct information can be printed on the desired location on the individual bag. The operation of the drive roller 58 creates a small amount of slack between the drive roller 58 of the printer assembly 40 and the drive roller 66 of the loading assembly 42.

Once the information has been printed on the bag, the print head 56 is raised and the drive roller 66 of the loading assembly is operated to remove the slack between the drive roller 58 and the drive roller 66. Further operation of the drive roller 66 pulls the printed bag past the nip and into position for loading. As can be understood in FIG. 2, this process is continuously repeated for each of the bags in the continuous strip.

If it is not critical that the bag being loaded is the last bag printed, the distance between the printer assembly 40 and the loading assembly 42 can be increased, which further expands the possible locations of the printed information on each individual bag. If it is critical that the bag be loaded immediately after printing, the location of the printed information on the bag is somewhat limited by the distance between the drive roller 66 and the drive roller 58.

Various alternatives and embodiments are contemplated as being within the scope of the following claims particularly pointing out and distinctly claiming the subject matter regarded as the invention.

We claim:

1. A combination device for printing information on each bag of a continuous strip of bags and positioning the bag for loading with a product, the device comprising:

a support frame including a feed assembly for feeding the continuous strip of bags;

a printer assembly positioned on the support frame to receive the continuous strip of bags, the printer assembly including a print head operable to print selected information on each individual bag as the bag moves through the printer assembly; and a loading assembly positioned on the support frame to receive the continuous strip of bags after the continuous strip of bags pass through the printer assembly, the loading assembly being operable to open each individual bag of the continuous strip to allow loading of the product into the bag;

wherein the loading assembly is positioned adjacent to the printer assembly such that the loading assembly opens the individual bag for loading immediately after the bag has been printed by the printer assembly such that no printed bags are positioned between the bag being loaded and the printer assembly, wherein the loading assembly includes a drive roller and a pinch roller that receive the continuous strip of bags therebetween, the drive roller being operable to advance the strip of bags from the printer assembly.

2. The combination device of claim 1 wherein the printer assembly includes a drive roller positioned beneath the print head, wherein the drive roller is operated independently from the drive roller of the loading assembly to advance the continuous strip of bags from the feed assembly during printing.

3. A combination device for printing information on each bag of a continuous strip of bags and positioning the bag for loading with a product, the device comprising:

a support frame including a feed assembly for feeding the continuous strip of bags;

a printer assembly positioned on the support frame to receive the continuous strip of bags, the printer assembly including a print head operable to print selected information on each individual bag as the bag moves through the printer assembly; and a loading assembly positioned on the support frame to receive the continuous strip of bags after the continuous strip of bags pass through the printer assembly, the loading assembly being operable to open each individual bag of the continuous strip to allow loading of the product into the bag;

wherein the loading assembly is positioned adjacent to the printer assembly such that the loading assembly opens the individual bag for loading immediately after the bag has been printed by the printer assembly such that no printed bags are positioned between the bag being loaded and the printer assembly, wherein the printer assembly is movable relative to the loading assembly such that the distance between the printing head and the loading assembly can be adjusted to compensate for the length of the individual bags of the continuous strip of bags.

4. The combination device of claim 3 wherein the printer assembly is mounted between a pair of guide rails such that the printer assembly is movable toward and away from the loading assembly along the guide rails.

5. A method of printing information on individual bags of a continuous strip of bags and loading a product into each bag, the method comprising the steps of:

positioning a printer assembly to receive the continuous strip of bags;

printing information on each individual bag of the continuous strip;

transferring the bag to a loading assembly after the bag has been printed;

opening the bag in the loading assembly for loading with a product before another bag is printed, such that no printed bags are positioned between the printer assembly and the loading assembly; and adjusting the distance between the printer assembly and the loading assembly based upon the length of each individual bag.

6. The method of claim 5 wherein the step of adjusting the distance includes moving the printer assembly relative to the loading assembly.

7. The method of claim 5 wherein the step of printing information on each individual bag includes the step of selecting specific information to be printed on each individual bag.

8. A method of printing information on individual bags of a continuous strip of bags and loading a product into each bag, the method comprising the steps of:

positioning a printer assembly to receive the continuous strip of bags;

printing information on each individual bag of the continuous strip;

transferring the bag to a loading assembly after the bag has been printed; and opening the bag in the loading assembly for loading with a product before another bag is printed, such that no printed bags are positioned between the printer assembly and the loading assembly, wherein both the printer assembly and the loading assembly include drive rollers, wherein the drive roller of the printer assembly is independently operable from the drive roller of the loading assembly.

* * * * *